US006239544B1

(12) United States Patent
Aono et al.

(10) Patent No.: US 6,239,544 B1
(45) Date of Patent: May 29, 2001

(54) FLAT-TYPE IMAGE DISPLAY APPARATUS WITH INSULATING POSITIONING MEMBERS

(75) Inventors: Hiroshi Aono, Osaka; Tomohiro Sekiguchi, Hyogo, both of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/299,806

(22) Filed: Apr. 26, 1999

(30) Foreign Application Priority Data

Apr. 28, 1998 (JP) ..... 10-119552

(51) Int. Cl.[7] ..... H01J 29/70
(52) U.S. Cl. ..... 313/422
(58) Field of Search ..... 313/422, 482, 313/586, 238, 243, 268, 258, 289, 292

(56) References Cited

U.S. PATENT DOCUMENTS

| | | |
|---|---|---|
| 4,145,633 | 3/1979 | Peters . |
| 4,900,981 | 2/1990 | Yamazaki . |
| 4,982,134 | 1/1991 | Aono et al. . |
| 5,504,387 | 4/1996 | Hamagishi . |

FOREIGN PATENT DOCUMENTS

| | | |
|---|---|---|
| 0 739 029 | 10/1996 | (EP) . |
| 62-29046 | 2/1987 | (JP) . |
| 2-288052 | 11/1990 | (JP) . |
| 3-67444 | 3/1991 | (JP) . |
| 4-249048 | 9/1992 | (JP) . |
| 4-249048 | 9/1995 | (JP) . |
| 96/30926 | 10/1996 | (WO) . |
| 97/15912 | 5/1997 | (WO) . |

*Primary Examiner*—Vip Patel
(74) *Attorney, Agent, or Firm*—Merchant & Gould, P.C.

(57) ABSTRACT

In a flat-type image display apparatus, thermal distortion caused by the exposure to high temperature is absorbed, thus obtaining assembly precision and maintaining it during operation. The apparatus comprises a flat type screen and a back electrode opposing the flat type screen. In the space between the flat type screen and the back electrode, linear cathodes and an electrode unit including an electron beam extracting electrode are arranged. Positioning members formed of heat-resistant insulators having guide portions for supporting the linear electrodes are attached to the electrode unit. The linear cathodes are positioned by the guide portions to keep a predetermined positional relationship with electron-beam extracting holes formed in the electron beam extracting electrode.

4 Claims, 9 Drawing Sheets

FLAT-TYPE IMAGE DISPLAY APPARATUS WITH INSULATING POSITIONING MEMBERS

FIELD OF THE INVENTION

The present invention relates to a flat-type image display apparatus used for a television receiver, a computer-terminal display unit, or the like.

BACKGROUND OF THE INVENTION

Recently, thinner color image display apparatus have been actively developed. As an example, Publication of Unexamined Japanese Patent Application (Tokkai-Hei) No. 3-67444 discloses a flat-type image display apparatus employing a beam scanning method in which the distance from a cathode to an anode is shortened significantly compared with a conventional cathode-ray tube (CRT) system. In the flat-type image display apparatus, a screen is divided into a plurality of subsections vertically. An electron beam is deflected vertically to display a plurality of lines on each subsection. Further, the screen is also divided into a plurality of subsections horizontally. In each subsection, phosphors of R, G, and B emit light sequentially. An amount of the electron beam irradiated onto the phosphors of R, G, and B is controlled by the received color picture signals. Thus, a television picture is displayed as a whole.

In the above-mentioned flat-type image display apparatus, an electrode unit and linear hot cathodes (hereafter referred to as "linear cathodes") as electron beam sources are housed in a flat-box type vacuum case. In the electrode unit, the distance from a cathode to an anode is shortened significantly. Electrodes forming the electrode unit are provided with small holes or slits for deflecting, focusing, and controlling electron beams emitted from the linear cathodes. The electron beams go through the electrodes while being controlled by the holes or slits in each electrode and accelerated to the anode to cause light emission of phosphors applied on the anode, thus displaying images.

FIG. 7 is an exploded perspective view showing the internal configuration of the aforementioned conventional flat-type image display apparatus. The flat-type image display apparatus comprises a back electrode 1, linear cathodes (in the figure, only four linear cathodes are shown) 2 extending horizontally, and an electrode unit 11 including signal control electrodes, which provides the main fictions of the apparatus. The signal control electrodes comprise an electron beam extracting electrode 3 and other electrodes 4–8 for, for example, focusing and deflecting electron beams. The sheet-shaped electrodes 3–8 are superposed via insulators and spacers, thus forming the electrode unit 11. In the electron beam extracting electrode 3, electron beam extracting holes 12 are formed. Electron beams 13 emitted from the linear cathodes 2 are extracted through the holes 12 so as to form an apparent one electron beam per hole. An extracted electron beam 13 is controlled, focused, and deflected by the electrodes 4–8 to scan a subsection 14 on the anode screen. The figure shows only one electron beam 13. However, the same number of electron beams as that of many electron beam extracting holes 12 are extracted from the holes 12.

A front case is formed of a flat-box type front glass case 9. The phosphors of R, G, and B are applied on the inner face of the front glass case 9 by being printed on subsections 14–16 forming the screen. Further, a metal-backed layer is formed on the subsections 14–16 to apply high voltage. The electron beams are accelerated to have high energy and strike the metal-backed layer, thus exciting the phosphors so that the phosphors emit light. The electron beam 13 allows the subsection 14 to emit light to display an image.

Similarly, other electron beams that are not shown in the figure cause light emission of a subsection 16 and others. Thus, light is emitted from all of the subsections to display images. Consequently, a desired image is displayed on the screen as a whole. The back electrode 1 is formed on a rear case 10. The rear case 10 and the front glass case 9 are combined and sealed, and then a vacuum is drawn on its inside, thus forming a flat-type image display apparatus.

FIG. 8 is a perspective view showing the appearance of a sealed flat-type image display apparatus. The front glass case 9 and the rear case 10 are baked to be sealed with low melting point glass thus forming a case. The front glass case 9 is provided with an exhaust pipe 17 for drawing the vacuum inside the case, a high-voltage terminal 18 of the anode, and outgoing terminals 19 for controlling various electrodes forming the electrode unit. By connecting a driving circuit, a signal processing circuit, or the like to the terminals externally, the flat-type image display apparatus functions as a television receiver or a display unit.

Internal components constructing the aforementioned flat-type image display apparatus are exposed to high temperature repeatedly in the fabrication and assembling process of the apparatus or in operation of the apparatus for displaying images. For instance, with respect to the fabrication and assembling process, the apparatus is exposed to high temperature in bonding a plurality of fixing platforms for attaching various electrodes onto the glass rear case using low melting point glass and in a baking process of combining and bonding the front case and the rear case. That is to say, for example, the low melting point glass applied on a peripheral adhering portion of a glass case is melted at about 500° C. to seal the glass case, and a process of drawing high vacuum inside the glass case after sealing the glass case is carried out in a heating furnace at about 300°–350° C. On the other hand, in the operation of the apparatus, a number of linear hot cathodes stretched in a plane are heated to a high temperature of 600°–700° C. for generating electron beams. Due to the heat radiation by the linear cathodes, the various internal electrodes also are exposed to the above-mentioned high temperature.

In order that a proper beam spot scans precisely the printed phosphor surface of the screen to avoid deviation of beam position on the screen so as to display vivid images with high precision, the apparatus must be assembled with a precision on a micron level and the precision must be maintained in the operation for displaying images. However, generally objects exposed to high temperature repeatedly are subjected to thermal deformation such as expansion and contraction repeatedly due to the temperature change. Therefore, the high temperature atmosphere and the maintenance of the high precision are physically incompatible with each other.

The problem in a conventional technique will be explained more specifically with reference to FIG. 9. FIG. 9 is a partially enlarged schematic perspective view showing conventional configurations for stretching linear cathodes and for fixing an electrode unit comprising various electrodes. A plurality of linear cathodes 2 are welded and fixed to (vertical type) springs 27 for stretching the linear cathodes 2. Although only one end portion is illustrated in FIG. 9, the linear cathodes 2 are supported at both ends by the springs 27. Thus, suitable tension is applied to the linear cathodes 2 to stretch them without looseness. In addition, the linear cathodes 2 are in contact with and are supported by guide surfaces of horizontal positioning protrusions 25 for horizontally positioning linear cathodes and vertical positioning protrusions 26 for vertically positioning linear cathodes. The horizontal positioning protrusions 25 and vertical positioning protrusions 26 are formed on the supporting platform 24 for stretching the linear cathodes 2. The guide surfaces of the horizontal and vertical positioning protrusions 25 and 26 are manufactured with high precision. Thus, the linear cathodes 2 are positioned with high precision.

Each linear cathode 2 stretched with high precision is positioned so as to pass the center of the electron beam extracting holes 12 manufactured with high precision in the electron beam extracting electrode 3. Then, the electrode unit 11 is fixed with screws 20. In an ordinary condition without temperature change, no problem is caused if all the components have the same thermal expansion coefficient and the temperature does not vary in the respective components. However, in the conventional example, the supporting platform 24 is made of ceramic (alumina) and a plurality of electrode plates forming the electrode unit are formed of iron. Therefore, due to the difference in their thermal expansion coefficients, even if various components are not thermally deformed in a heat process of the fabrication, in the operation of the image display apparatus, the linear cathodes 2 are deviated from the center of the electron beam extracting holes 12 by about 100 $\mu$m in a 14-inch apparatus (an object value of the deviation is 20 $\mu$m or less). As a result, it is difficult to focus and deflect electron beam uniformly. Consequently, the basic function as an image display apparatus cannot be obtained.

Further, since the supporting platform 24 is required to be manufactured with high precision, grinding and polishing process requiring many steps have to be carried out. Therefore, one more problem is that the cost reduction is difficult.

SUMMARY OF THE INVENTION

It is an object of the present invention to solve the problem in the aforementioned conventional flat-type image display apparatus and to provide a flat-type image display apparatus in which thermal distortion caused by high temperature in a driving operation and in fabrication processes is absorbed and a desired assembly precision can be obtained and maintained.

It is a further object of the present invention to provide an inexpensive flat-type image display apparatus in which the cost for members for stretching linear cathodes can be reduced and uniform images can be displayed.

A flat-type image display apparatus of the present invention has the following configuration. In the space between a flat type screen and a back electrode that is arranged opposing the flat type screen, linear cathodes, an electron beam extracting electrode, a signal electrode, a focusing electrode, a horizontal deflection electrode, and a vertical deflection electrode are arranged and are housed in a case. The case is sealed and the inside is kept under vacuum. In order to attain the aforementioned objects, the flat-type image display apparatus of the present invention is characterized by improving the configuration as follows. An electrode unit formed by superposing the electrodes except for the back electrode via insulators to be a unit is arranged above an upper surface of the back electrode. Positioning members having guide portions for supporting the linear electrodes are attached to the electrode unit. The positioning members are formed of heat-resistant insulators. The linear cathodes are positioned by the guide portions, so that the linear electrodes keep a predetermined horizontal-position relationship with electron-beam extracting holes formed in the electron beam extracting electrode and face the electron beam extracting electrode while keeping a predetermined distance.

According to this configuration, the positioning members and the electrode unit move as one component. Therefore, even if thermal distortion is caused by the exposure of the apparatus to high temperature and in fabrication processes and in operation for image display, the positioning members and the electrode unit are not displaced relative to each other. Thus, a desired assembly precision between the linear cathodes and the electron beam extracting holes can be obtained and maintained.

In addition, according to the present invention, manufacturing of the apparatus is simple without requiring complicated machining. Therefore, it can provide an inexpensive flat-type image display apparatus that enables the cost for members for stretching linear cathodes to be reduced and displays uniform images.

It is preferable that horizontal positioning members with a projecting guide portion for supporting a linear cathode horizontally are arranged individually for each row of electron beam extracting holes and are incorporated into an electrode unit, and a vertical positioning member with a guide portion for supporting linear cathodes vertically is attached to the electron beam extracting electrode.

It is further preferable that each of the positioning members comprises a horizontal guide portion for supporting the linear cathode horizontally and a vertical guide portion for supporting the linear cathodes vertically. The positioning member is arranged for each linear cathode respectively. Such a configuration enables the heat-resistant insulators to have a shape that can be formed by press-forming, thus reducing the cost.

It also is preferable that the electron beam extracting electrode has attachment holes, each of which is provided for each row of the electron-beam extracting holes for attachment of the positioning members. The attachment holes comprises an insertion portion, a supporting reference portion, and a pawl for preventing the positioning members from slipping off. The positioning members are inserted into and set in the attachment holes. With such a configuration, the fabrication process can be simplified.

DESCRIPTION OF THE PREFERRED EMBODIMENTS

According to a preferable example of the present invention, an image display apparatus has the following configuration. The image display apparatus comprises a flat-type screen on which phosphors have been applied and a back electrode made of a conductive material that is arranged opposing the screen. In the space between the flat-type screen and the back electrode, linear cathodes stretched with springs, an electron beam extracting electrode, a signal electrode, a focusing electrode, a horizontal deflection electrode, and a vertical deflection electrode are arranged and are housed in a case formed of a front case and a rear case. The case is sealed and the inside is kept under vacuum. The electrodes except for the back electrode are superposed via insulators to form a unit, thus obtaining an electrode unit. The electrode unit is positioned above the upper surface of the back electrode. Positioning members made of heat-resistant insulator are arranged individually between rows of electron beam extracting holes of the electron-beam extracting electrode. The positioning members have guide portions for supporting linear cathodes so as to face the electron beam extracting electrode with a predetermined distance being kept therebetween. As the heat-resistant insulators, ceramics such as Al2O3, those having an insulating coating film of ceramics or the like on the surface of metal, or the like can be used.

Embodiments of the present invention will be explained with reference to the figures as follows. The same portions as in the conventional example are indicated with the same reference numbers, which permits an easy understanding of the figures.

Figure 1:
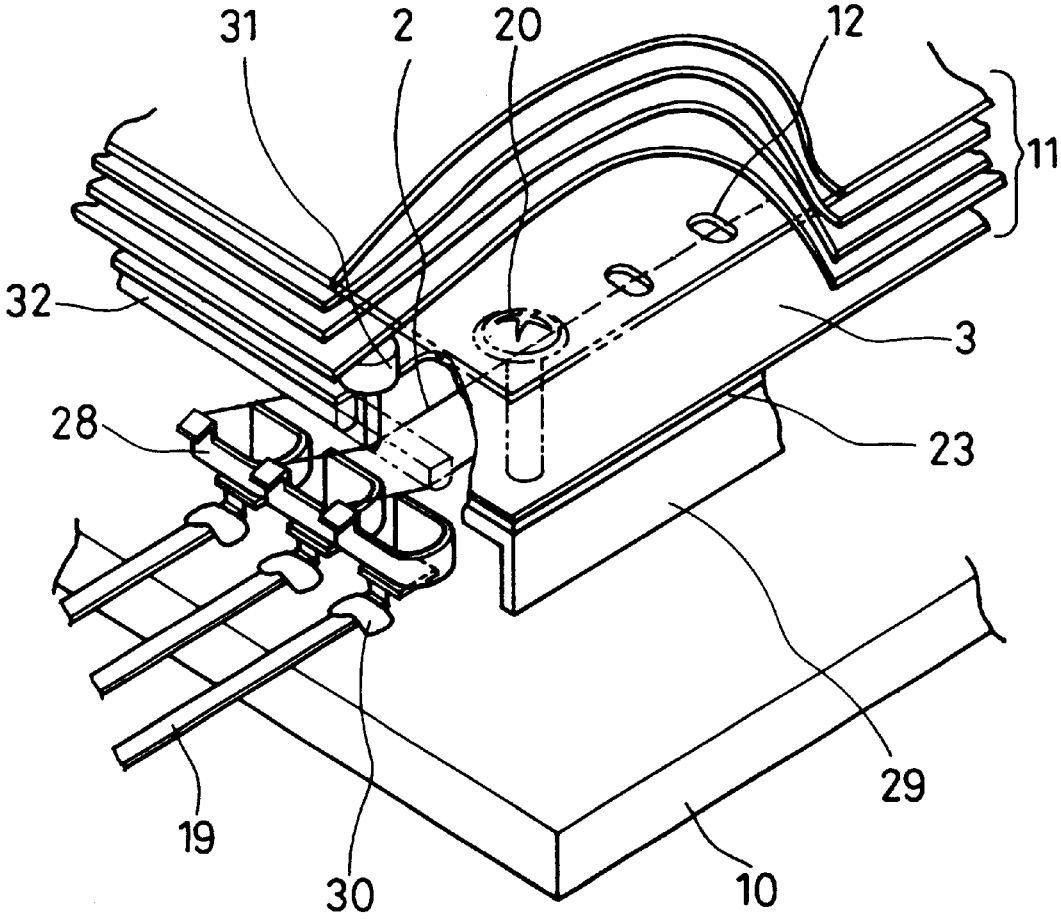
FIG. 1 is a partially enlarged perspective view showing configurations for stretching linear cathodes and for fixings an electrode unit comprising various electrodes in a flat-type image display apparatus in an embodiment of the present invention.

FIG. 1 is a partially enlarged perspective view showing a configuration for stretching linear cathodes in a flat-type image display apparatus in a first embodiment of the present invention. An electrode unit 11 is fixed to an electrode supporting metal member 29 using screws 20 for fixing the electrodes via an insulator 23. The electrode supporting metal member 29 is provided on a rear case 10. Linear cathodes 2 are fixed to and are stretched by linear cathode stretching springs 28 (horizontal type). The linear cathodes 2 are positioned with a predetermined positional relationship with electron-beam extracting holes 12 provided in an electron beam extracting electrode 3. The positioning of the linear cathodes 2 is settled by contact with positioning members including horizontal positioning members 31 made of the heat-resistant insulator for positioning linear cathodes horizontally and a vertical positioning member 32 made of the heat-resistant insulator for positioning linear cathodes vertically.

Each horizontal positioning member 31 has a positioning guide portion formed with high precision. For instance, each linear cathode 2 is positioned by the horizontal positioning member 31 so as to pass the center of the electron beam extracting holes 12 in a row. The vertical positioning member 32 also has a similar positioning guide portion. For example, the linear cathode 2 is positioned by the vertical positioning member 32 at a predetermined position between the electron beam extracting electrode 3 and an opposing electrode against the electrode 3. The springs 28 are fixed onto the rear case 10 with adhesive frit glass 30. Although only one end portion is illustrated in FIG. 1, the linear cathodes 2 are supported at both ends by the similar structure.

Fabrication processes of the main parts in the flat-type image display apparatus with the above-mentioned configuration will be explained with a more particular configuration.

Figure 5:
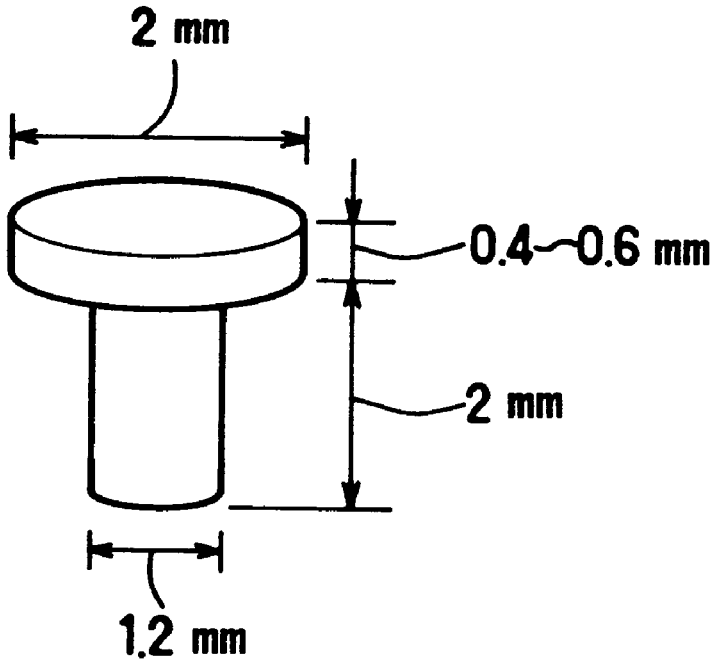
FIG. 5 is a perspective view showing the shape of a horizontal positioning member in an embodiment of the present invention.

The electron beam extracting electrode 3 to be attached to the rear case 10 is prepared. The horizontal positioning members 31 are arranged individually per row of the electron beam extracting holes 12 in the electrode 3 and are fixed so as to be incorporated into a gap between electrodes in the electrode unit 11. In the example of FIG. 1, the horizontal positioning members 31 are arranged between the electron beam extracting electrode 3 and the electrode positioned over the electrode 3. As shown in FIG. 5 as an example, a horizontal positioning member 31 has substantially a thumbtack-shape. The upper part of the horizontal positioning member 31 has a disc shape with a diameter of about 2 mm and a thickness of about 0.4 to 0.6 mm. The horizontal positioning member 31 has a post with a diameter of about 1.2 mm and a length of about 2 mm at the center of the upper part.

Figure 6:
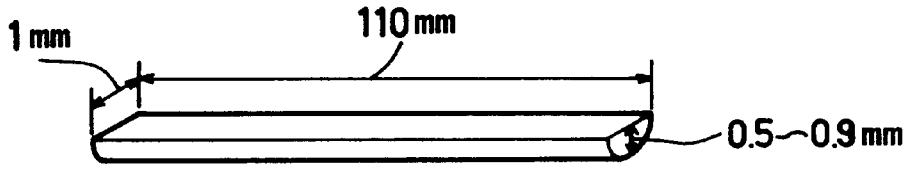
FIG. 6 is a perspective view showing the shape of a vertical positioning member in an embodiment of the present invention.
Figure 7:
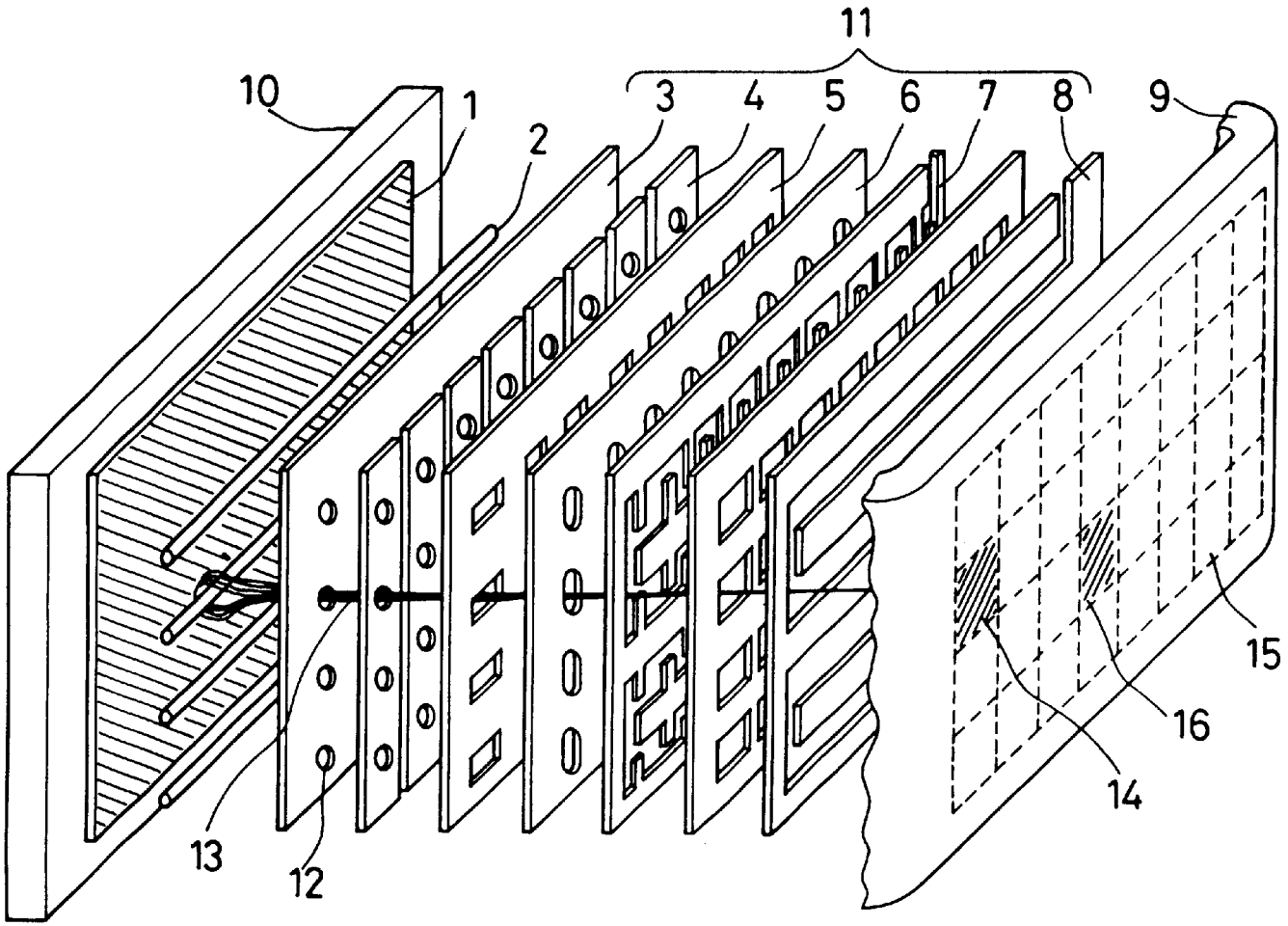
FIG. 7 PRIOR ART
FIG. 7 is an exploded perspective view showing the internal configuration of a conventional flat-type image display apparatus.
Figure 8:
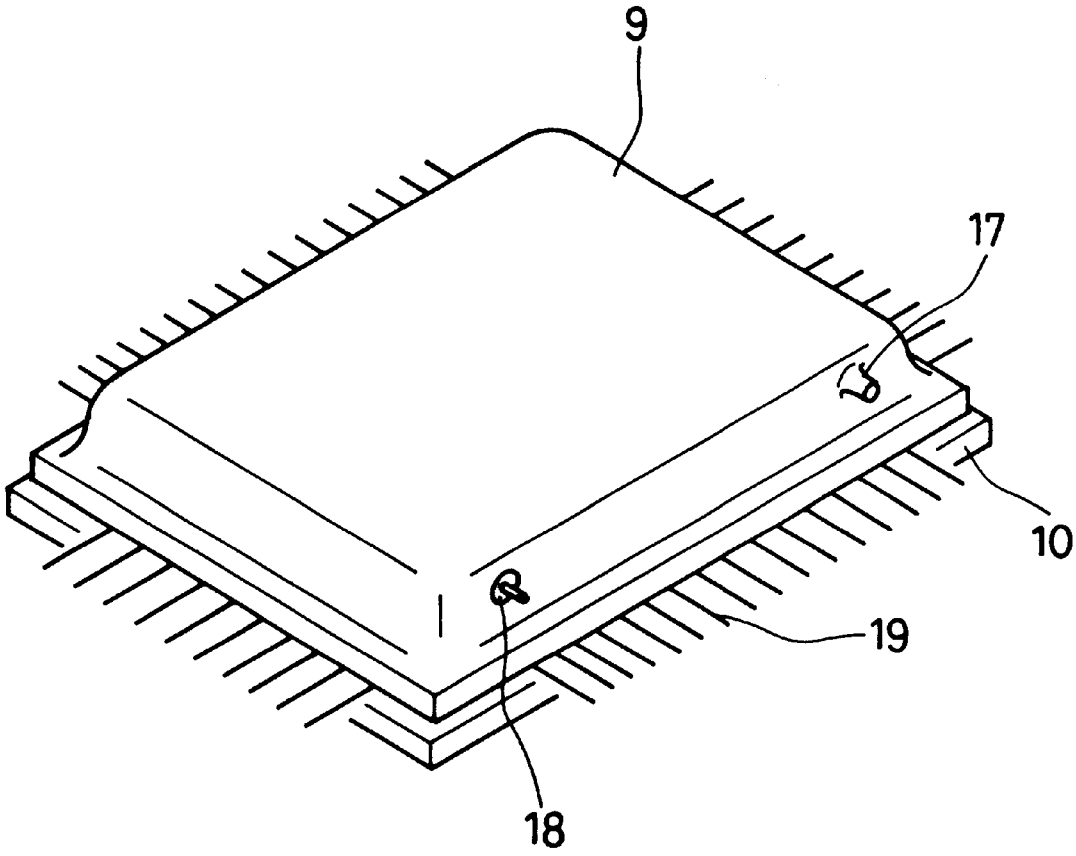
FIG. 8 PRIOR ART
FIG. 8 is a perspective view showing the appearance of the conventional flat-type image display apparatus.
Figure 9:
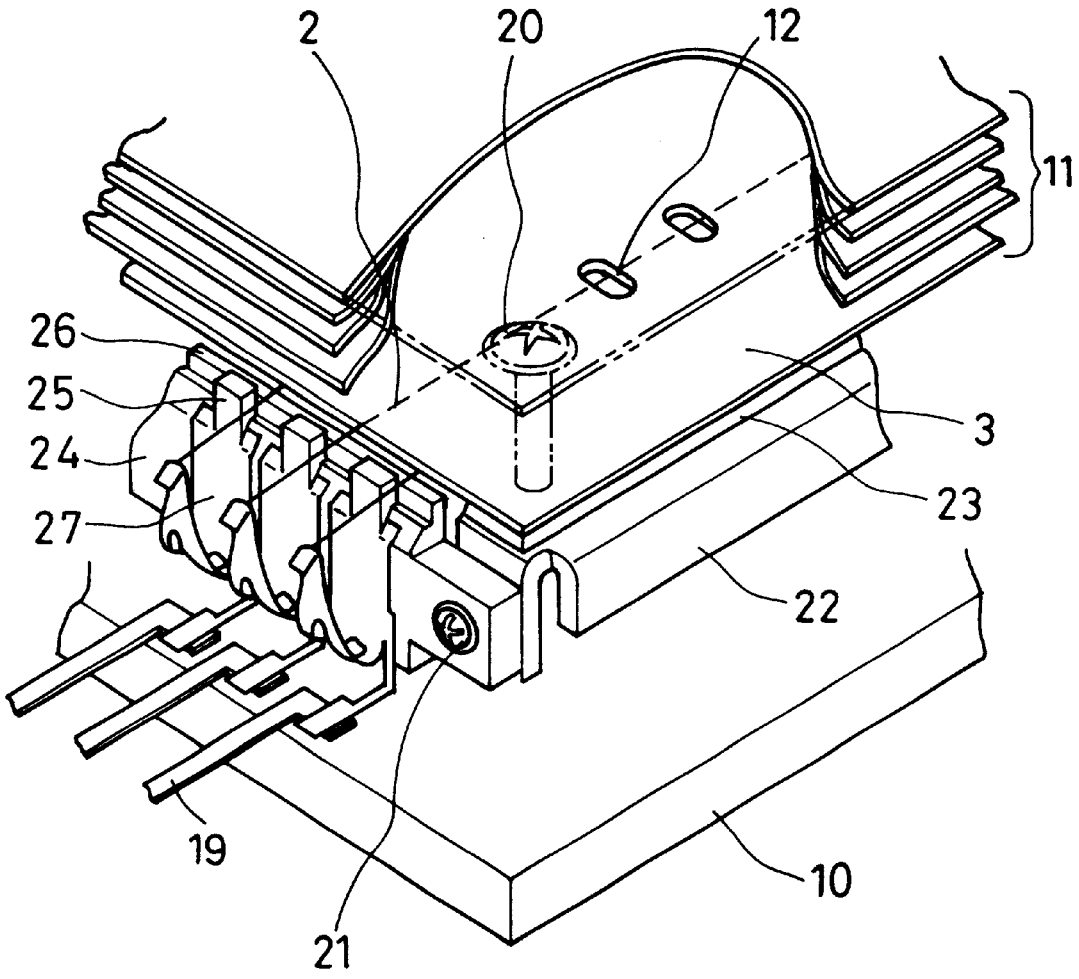
FIG. 9 PRIOR ART
FIG. 9 is a partially enlarged schematic perspective view showing conventional configurations for stretching linear cathodes and for fixing an electrode unit including various electrodes.

The vertical positioning member 32 is attached to the electron beam extracting electrode 3 at the position where no gap is caused between the vertical positioning member 32 and the linear electrode 2 after the assembly. The vertical positioning member 32 may be fixed to a position except for the contact portion with the linear cathode 2 by a welding method using another metal fixture or a riveting method. As shown in FIG. 6 as an example, the vertical positioning member 32 has a columnar shape with a semicircular, half-elliptical, or circular cross-section. When having a semicircular cross-section, the vertical positioning member 32 has a diameter of about 0.5 to 0.9 mm and a length of about 110 mm (in a case of a screen size of 7 inches).

Separately, the springs 28 are fixed to the rear case 10 and the linear cathodes 2 are welded and thus fixed to the springs 28 respectively.

As a next step, the electrode unit 11 in which the horizontal positioning members 31 and the vertical positioning member 32 are incorporated is placed on the rear case 10 with both the positioning members 31 and 32 being in contact with the linear cathodes 2. The electrode unit 11 is fixed to the electrode supporting metal member 29 via the insulator 23 using the screws 20. In assembling those members, it is preferable that the portion of the spring 28 to which each linear cathode 2 is fixed is set back from the surfaces of the positioning guide portions of the positioning members 31 and 32, as shown in FIG. 1. Thereby the linear cathode 2 is pushed against the positioning guide portions and supported on it, so that the positioning of the linear cathode 2 is achieved securely.

Figure 2:
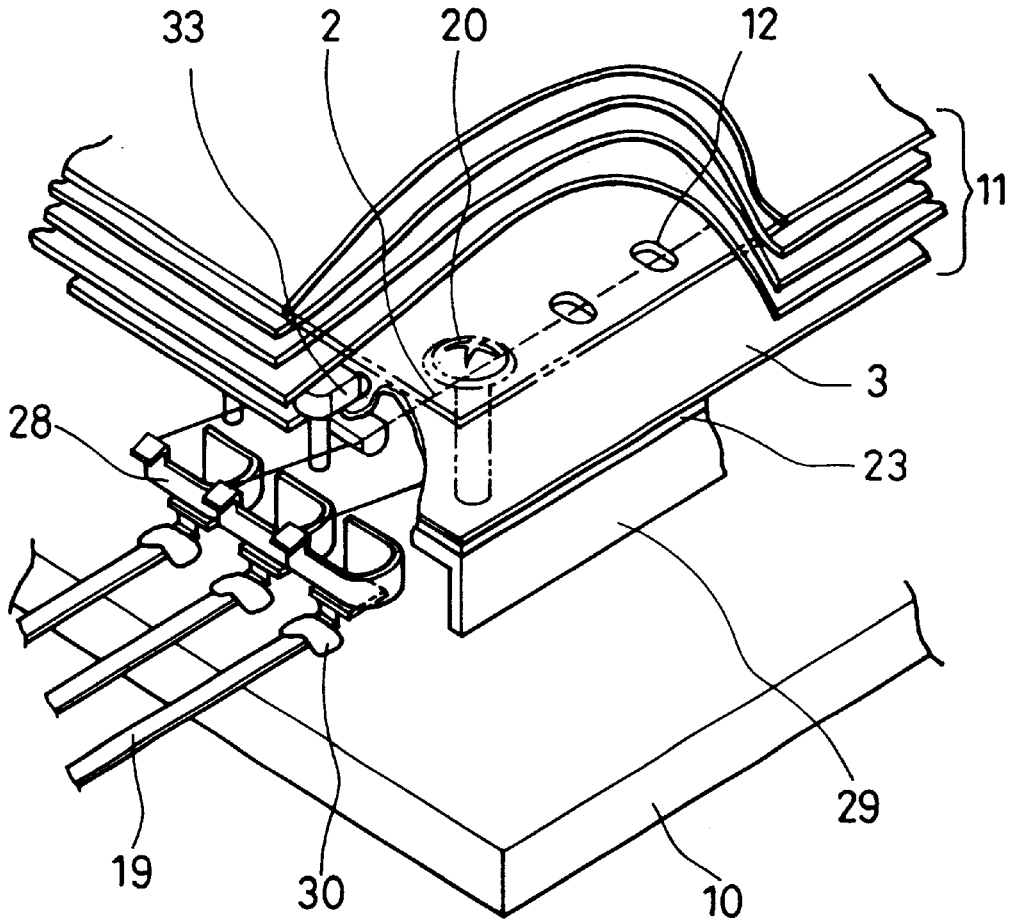
FIG. 2 is a partially enlarged perspective view showing configurations for stretching linear cathodes and for fixing an electrode unit comprising various electrodes in a flat-type image display apparatus in another embodiment of the present invention.

FIG. 2 is a partially enlarged perspective view showing a configuration for stretching linear cathodes in a flat-type image display apparatus in a second embodiment of the present invention. Positioning members 33 made of a heat-resistant insulator for positioning the linear electrodes are arranged individually per row of electron beam extracting holes 12 in an electron beam extracting electrode 3. The positioning members 33 are incorporated into a gap between the electrode 3 and the electrode over the electrode 3 in an electrode unit 11. In the first embodiment, a common vertical positioning member 32 is used for the plurality of linear cathodes 2. On the contrary, in the present embodiment, an individual positioning member for positioning a linear cathode vertically is provided for each linear cathode 2 and is integrated with a positioning member for positioning a linear cathode horizontally, thus forming a positioning member 33. The other configuration is the same as in the first embodiment.

Figure 3:
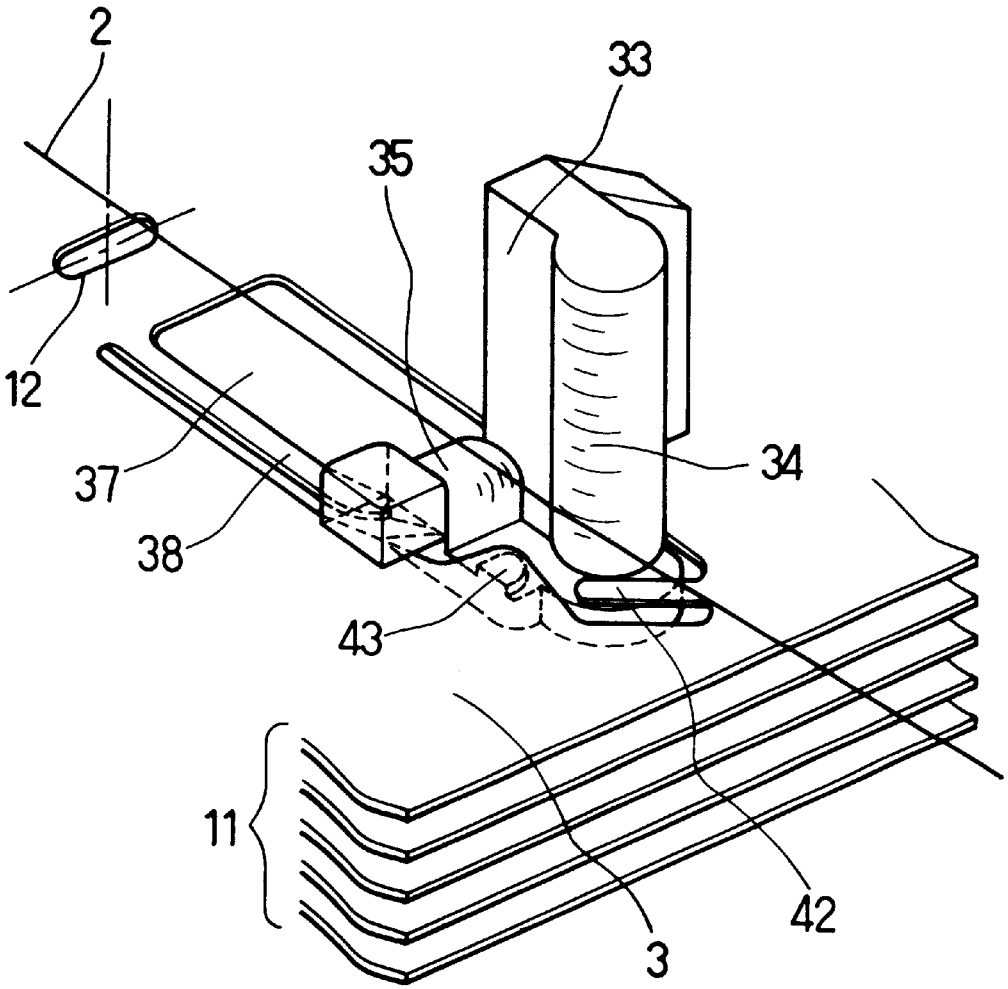
FIG. 3 is a partially enlarged perspective view (seen from the back face of an electrode unit) illustrating an example of a method of incorporating positioning members for positioning linear cathodes into the electrode unit as shown in FIG. 2.

FIG. 3 is a perspective view seen from the back face of the electrode unit 11 showing a configuration of the positioning member 33 and the state in which the positioning member 33 is incorporated into the electrode unit 11 shown in FIG. 2. The positioning member 33 has a horizontal positioning portion 34 for positioning a linear cathode horizontally and a vertical positioning portion 35 for positioning a linear cathode vertically. The positioning member 33 is inserted into an insertion portion 37 of a hole provided in the electron beam extracting electrode 3, in order to be attached to the electrode 3. Further, the positioning member 33 is provided with a protrusion 43 for preventing the positioning member 33 from being wobbly that is shown with a dotted line in FIG. 3. The protrusion 43 closely contacts with the electrode 3 in the opposite side of the positioning portions 34 and 35. Thus positioning member 33 bites into the electrode 3. The positioning member 33 is positioned by a pawl 38 and a positioning auxiliary leaf 42. The pawl 38 is provided in the electrode 3 for preventing the positioning member 33 from slipping off, so that the positioning member 33 is fixed to the electrode 3.

Figure 4:
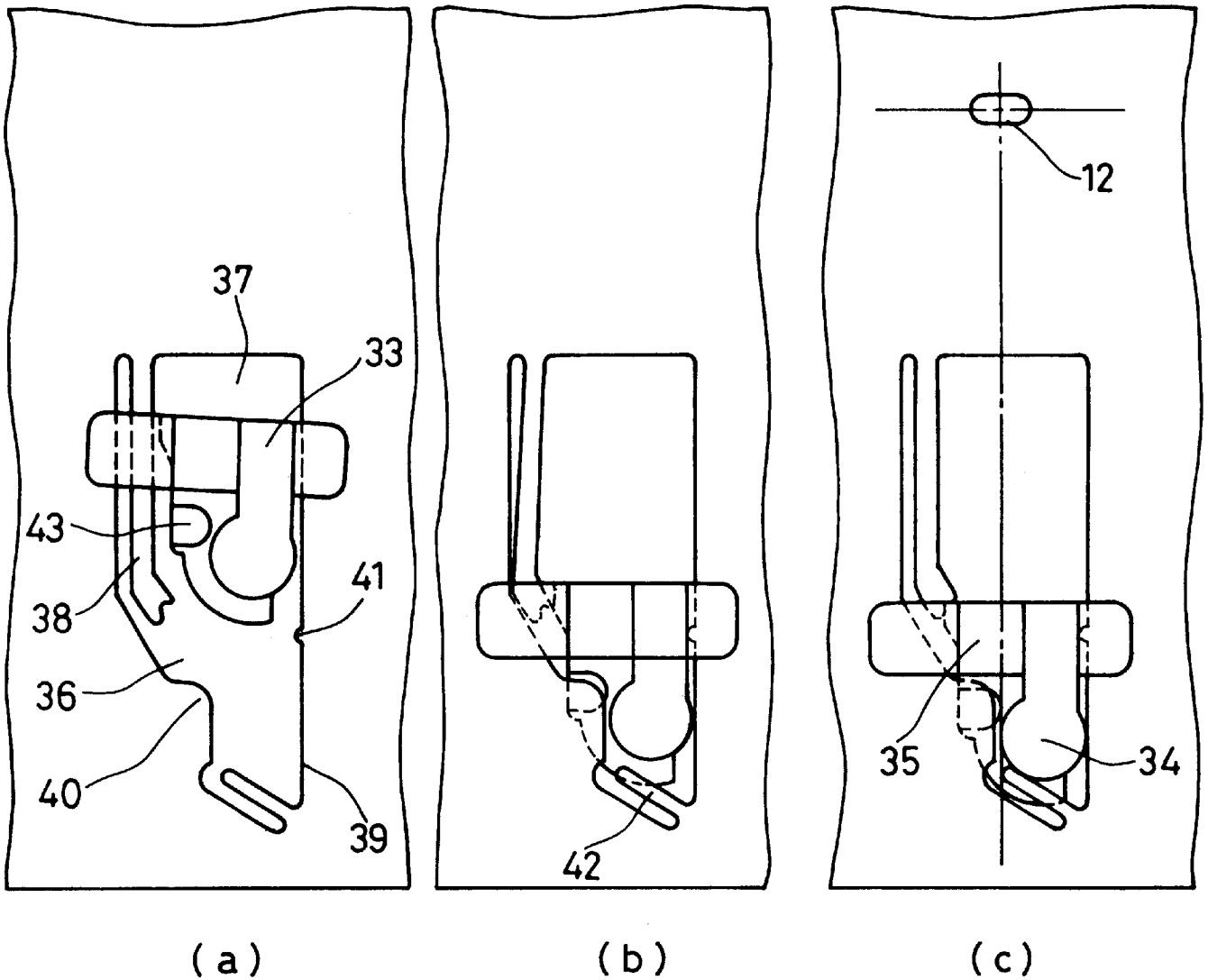
FIG. 4*a–c* are views showing enlarged back faces illustrating an example of a method of incorporating the positioning members into the electrode unit as shown in FIG. 2.

FIG. 4 shows steps for incorporating the positioning member 33 shown in FIGS. 2 and 3 into the electrode unit 11.

As shown in FIG. 4, the electrode 3 is provided with an attachment hole 36 having the insertion portion 37, a supporting reference portion 39, and the pawl 38. The positioning member 33 is dropped into the insertion portion 37 (FIG. 4(*a*)).

Then, the positioning member 33 is forced to slide toward the supporting reference portion 39. At that time, the pawl 38 is pushed by a rear-lower portion of the positioning member 33 to be bent. The stress caused by the bend is preferably within the elastic limit. Further, the positioning member 33 slides into the supporting reference portion 39 with the protrusion 43 being pressed by a portion 40 for preventing the positioning member 33 from being wobbly (FIG. 4(*b*)).

Finally, the horizontal positioning portion 34 comes into contact with and is pressed by the positioning auxiliary leaf 42 while being in contact with the supporting reference portion 39. At the same time, the pawl 38 is released from the bend and is restored to the original position, pressing the rear-lower portion of the positioning member 33 (FIG. 4(*c*)). The elasticity of the positioning auxiliary leaf 42 cancels dimension errors of various components, brings the horizontal positioning portion 34 of the positioning member 33 into contact with the supporting reference portion 39 reliably.

The positioning auxiliary leaf 42 functions for preventing the positioning member 33 from slipping off. Moreover, the protrusion 43 is pressed by the portion 40. Through this contact, the vertical positioning portion 35 is positioned in relation to the electron beam extracting electrode 3. The supporting reference portion 39 is arranged to position the surface of the horizontal positioning portion 34 in contact with a linear cathode so as to coincide in the horizontal direction with the center of the electron beam extracting hole 12 (shown with an alternating long and short dash line).

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A flat-type image display apparatus comprising:

a cavity formed by a front case and a rear case connected to each other, the cavity being kept under vacuum;

a flat type screen formed on the front case;

a back electrode opposing the flat type screen;

an electrode unit including an electron beam extracting electrode with electron-beam extracting holes, a signal electrode, a focusing electrode, a horizontal deflection electrode, and a vertical deflection electrode, which are arranged in the space between the flat type screen and the back electrode;

linear cathodes extending in a predetermined positional relation with the electron beam extracting electrode; and positioning members being disposed at both ends of the linear cathodes and attached to the electrode unit, which are formed of heat-resistant insulators and have guide portions for being contact with the linear electrodes, the wherein, through the contact with the guide portions, the linear cathodes are positioned both in the horizontal direction within the plane of the flat type screen and in the vertical direction perpendicular to the plane, so that the linear electrodes keep the predetermined positional relationship horizontally with the electron-beam extracting holes and vertically with the electron beam extracting electrode.

2. A flat-type image display apparatus according to claim 1, wherein the positioning members comprise:

horizontal positioning members incorporated into the electrode unit and having a horizontal guide portion for supporting a linear cathode horizontally that projects from the electron beam extracting electrode toward the back electrode; and a pair of vertical positioning member attached to the electron beam extracting electrode and positioning the linear cathodes vertically with a vertical guide portion.

3. A flat-type image display apparatus according to claim 1, wherein each of the positioning members comprises a horizontal guide portion for supporting the linear cathode horizontally and a vertical guide portion for supporting the linear cathodes vertically, the positioning member being provided for each linear cathode respectively.

4. A flat-type image display apparatus according to claim 3, wherein the electron beam extracting electrode has attachment holes provided for each row of the electron-beam extracting holes for attachment of the positioning members, the attachment holes comprising an insertion portion, a supporting reference portion, and a pawl for preventing the positioning members from slipping off; and the positioning members are inserted into and set in the attachment holes.

* * * * *